US005707279A

United States Patent [19]

Mitchell et al.

[11] Patent Number: 5,707,279

[45] Date of Patent: Jan. 13, 1998

[54] ABRASIVE TOOL

[75] Inventors: William A. Mitchell, Cleveland; Arthur E. Ellison, Shaker, both of Ohio

[73] Assignee: Even Cut Abrasive Company, Cleveland, Ohio

[21] Appl. No.: 661,448

[22] Filed: Jun. 11, 1996

[51] Int. Cl.[6] ..... B24D 9/00

[52] U.S. Cl. ..... 451/512; 451/504; 451/506; 451/514; 451/513

[58] Field of Search ..... 451/495, 504, 451/506, 508, 511, 512, 514, 516, 515, 517, 513

[56] References Cited

U.S. PATENT DOCUMENTS

| | | | |
|---|---|---|---|
| 661,282 | 11/1900 | Bachman | 451/512 |
| 3,545,142 | 12/1970 | Sullenberger | 451/506 |
| 3,869,832 | 3/1975 | Atwater | 451/504 |
| 3,965,521 | 6/1976 | Wardell | 451/504 |
| 4,291,507 | 9/1981 | Littlehorn, Jr. | 451/506 |

FOREIGN PATENT DOCUMENTS

| | | | |
|---|---|---|---|
| 559229 | 9/1932 | France | 451/504 |

*Primary Examiner*—Eileen P. Morgan
*Attorney, Agent, or Firm*—Renner, Otto, Boisselle, Sklar

[57] ABSTRACT

An abrasive tool includes in combination a tubular sleeve of exteriorly coated abrasive which has an axial length and an inside diameter. A drive arbor for the sleeve includes a mandrel adapted to be rotated by a power tool and the like. An elastomeric generally cylindrical arbor is mounted on one end of the mandrel and has an outer and inner axial end. The arbor includes a radially projecting stop flange at its inner end and has a tapered configuration between the stop flange and its outer end to receive the abrasive tubular section, but which creates an interference fit as the tubular section is telescoped on the arbor until one axial end of the tubular section engages the stop flange. The arbor body is provided with non-radial slots which make the body more pliable in a static condition, but which improve the grip of the arbor on the sleeve at speed. The slots also improve heat dissipation.

17 Claims, 1 Drawing Sheet

ABRASIVE TOOL

This invention relates generally as indicated to an abrasive tool and more particularly to a power tool arbor gripping and rotating a right circular cylindrical tubular abrasive sleeve.

BACKGROUND OF THE INVENTION

Sandpapers of various grades are converted into various tools used for grinding, polishing and abrading. The tools run the gamut from small disks to flap wheels. One such conversion is to a spiral wound tube which is then cut into right circular cylindrical sleeves or tubular segments. These segments are then mounted on a drive arbor and driven for rotation. They make a very effective abrasive tool with a wide variety of applications. The size or diameter may range from quite small such as somewhat more than a centimeter, to 5–8 centimeters or more. The coarseness of the sandpaper exterior coating and the backing may also vary widely.

Such tubular segments or sleeves can be made with a closely controlled inside diameter and may be telescoped over a drive arbor or chuck of a hand tool which is usually electric motor or air motor driven for rotation. Such tubular segments or sleeves may also be used on bench tools where the work is manually or automatically held.

Soft rubber arbors are oftentimes employed to secure the abrasive sleeve or tubular segment to the spindle. Such arbors form a yieldable core or backing for the abrasive tubular segment, but also grip the segment for rotation under load as the tool is used. The torque may be significant. It is also important that the tubular segment not slip off the arbor during use. In some applications the tool is moved axially during use which may create a component of force tending to move the segment axially off the arbor. In small hand-held tools this component is usually toward the hand of the operator, especially if the work is contacted toward the outer corner or edge of the sleeve or tubular segment. In other words, if the sleeve slips with respect to the arbor, it often slips inwardly.

In many applications, the sleeves or segments require frequent replacement either because they are worn out or loaded to the point of being ineffective. Indeed, the sleeve segments are the low cost consumable part of the abrading system. To be effective and efficient, the replacement on the arbor should be as quick and easy as possible. If not, more time may be spent changing tooling than working. This is also true if the operator wants to switch to a sleeve with different abrasive characteristics.

Soft rubber cores or chucks have been employed as arbors, but they usually require some mechanism to expand the arbor inside the tubular segment. One such system utilizes a headed left-hand threaded mandrel. A rubber cylindrical arbor slides over the mandrel against the head and a nut and washer axially clamps the arbor against the head. Before the nut is tightened on the mandrel, the tubular abrasive segment easily telescopes over the arbor. However, firmly to grip the tubular segment, the nut has to be tightened on the mandrel which causes the arbor to distort or bulge outwardly gripping the inside of the tubular abrasive segment. The axial clamping of the arbor between the head and nut has to be released before the tubular segment can easily be removed. Also in such system there is no restriction on axial movement of the sleeve other than the distortion or bulging of the sleeve which normally is most acute midway between the axial ends.

The one advantage of this system is that the tolerance of the inside diameter of the tubular segment need not be maintained closely since the relaxation of the arbor allows the segment freely to move axially with some clearance. This advantage, however, becomes a disadvantage if the nut loosens. Other types of expandable arbors are also used but suffer the same disadvantage if the bulging or distortion is lost during operation. More importantly, the time consumed to loosen or tighten the nut, usually with a tool such as a pair of pliers or a wrench, makes the tool changing process lengthy and the work inefficient.

As with any powered abrading operation, heat is generated, and such heat contributes to tool wear and other problems. This is particularly true with soft rubber cores. Prolonged elevated temperatures can change the characteristics of the core, and eventually lead to its disintegration or failure.

SUMMARY OF THE INVENTION

An abrasive tool uses a cylindrical tubular section or sleeve of exteriorly coated abrasive having an axial length and an inside diameter. A drive arbor for the tubular section includes a mandrel adapted to be rotated by a power tool and the like, and an elastomeric generally cylindrical arbor secured to one end of the mandrel and having an outer and inner axial end. The arbor includes a radially projecting stop flange at its inner end, and has a exterior configuration between the stop flange and its outer end to receive the abrasive tubular section or sleeve with an interference fit as the abrasive sleeve is telescoped on the arbor until one axial end of the sleeve engages the stop flange. The inside diameter of the sleeve is slightly larger than the outside diameter of the arbor body at its outer end but slightly smaller than the outside diameter at the inner end or stop flange of the arbor body. The arbor tapers slightly from the flange to the outer end. Where the end of the abrasive sleeve engages the flange, the material and configuration of the arbor permits it to deform slightly to reduce its diameter at the flange yet increasing its diameter or bulging toward the outer end providing a substantially more uniform grip on the interior of the sleeve. Yet the sleeve may readily be manually forced on or pulled off the arbor. This is in part due to the slotted configuration of the arbor body.

The tapered arbor body from a position near the stop flange, extending to the outer end, is provided with a series of non-radial slots. The radially inner ends of the slots are uniformly offset from the axis of the arbor body and such slots extend chordally to the exterior of the arbor body. The slots may vary in number and may flare slightly as they progress chordally outwardly. The slots improve the ability of the sleeve to be inserted on and removed from the arbor body in a static condition of the tool. The slots thus form a series of asymmetrical projections which permit the exterior of the body to be more pliable to enable the sleeves more easily to be pulled off or forced on the body when not rotating. Yet under speed, centrifugal force makes the asymmetrical projections tend to want to straighten out and become symmetrical and radially expand, gripping the inside diameter of the sleeve more forcefully. Although the tool can be rotated in either direction, the tendency of the asymmetrical sections to expand is not circumferentially uniform and such projections form expanding gripping fingers which expand even more due to the torque between the sleeve and arbor body when the tool is rotated in one direction. The slots also serve as internal passageways to dissipate heat generated by the abrading operation. The invention provides a low-cost yet effective sandpaper sleeve tool, yet which enables the sleeve to be removed and installed quickly.

The arbor is made of a soft and yieldable elastomer such as a nitrile compound and has a durometer on the shore A scale of from about 45 to about 60. The arbor body is molded on a knurled end of the mandrel which projects axially from the stop flange end of the body.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
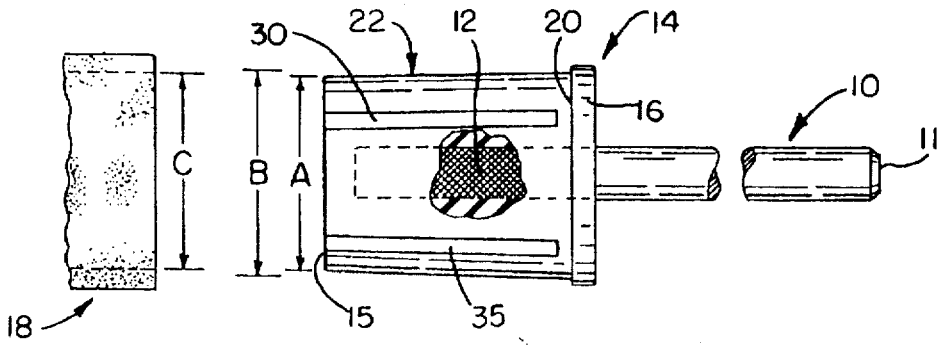
FIG. 1 is a side elevation partially broken away and in section showing the mandrel, arbor and abrasive tubular sleeve, the latter aligned but removed from the arbor.

Referring initially to FIG. 1, there is illustrated a steel mandrel 10 which has a chamfered end 11 and a knurled end 12. Molded on the knurled end of the mandrel is a relatively soft rubber-like arbor shown generally at 14 which includes an axial outer circular end 15 and an inboard stop flange 16 at its axial inner end.

Shown axially aligned with the arbor 14 is a cylindrical tubular abrasive sleeve or segment 18 which is formed from a coated abrasive. A coated abrasive has abrasive on one side and that abrasive is adhered to a backing which may be paper or cloth. Sandpaper and emery cloth are forms of coated abrasive and the abrasive and backing may vary widely.

The cylindrical tubular segment or sleeve 18 with the abrasive on the exterior is made in the same manner as a spiral paper or cardboard tube with the exterior layer being the coated abrasive. The tube is then cut transversely into relatively short axial length segments. Tubular sleeves or segments may be made also with lapped or butt spliced abrasive tape bands. It is preferred, however, that the axial length of the cylindrical abrasive tubular segment be the same as the length of the arbor from the inside or shoulder of the flange shown at 20 to the outer end 15 so that the outer end 15 is substantially flush with the abrasive tubular segment or sleeve when the segment is installed or seated on the arbor as shown in FIG. 2.

Figure 2:
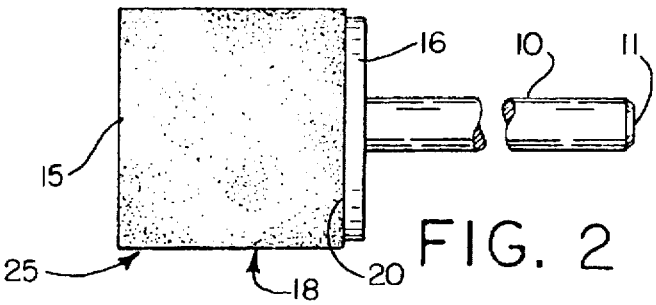
FIG. 2 is a side elevation of the components assembled.

In the embodiments shown in FIGS. 1 and 2, the exterior of the arbor body shown at 22 has a very slight taper so that the diameter at the end 15 shown at A is slightly smaller than the diameter at the shoulder 20 as seen at B. The interior of the cylindrical tubular segment or sleeve 18 shown at 24 has a diameter C which is larger than the diameter A but smaller than diameter B.

As an example, the diameter A may range from approximately 0.492 to about 0.496 inches (12.5 to 12.6 mm), while the diameter B may vary about 0.500 inches to about 0.504 inches (12.7 to 12.8 mm). Accordingly, the differences between the diameters of the two ends of the arbor may be slight such as only from about one to three tenths of a millimeter while the internal diameter C is between the two diameters. In this manner the arbor is, rather than perfectly cylindrical, in the form of a cone wedge. The slight diameter variation enables the tubular cylindrical abrasive segment or sleeve to be slipped on the end 15 of the arbor body but requires some force to drive the segment to the shoulder 20. The segment is held in place by an interference fit with the outside diameter of the arbor being constricted at the shoulder and deforming axially outwardly toward the end 15. In this manner, the deformation of the arbor body caused by the telescoping of the abrasive segment thereover more uniformly grips the interior of the segment axially even though the greatest interior grip is toward the inner end. The flange 16 forming the stop shoulder 20 precludes the abrasive segment from moving axially inwardly or to the right in FIGS. 1 and 2.

With the abrasive segment in place, the mandrel 10 will be chucked onto the spindle of an electric or air motor tool which may normally be hand held. When hand held, the work is normally contacted toward the outer end of the segment as shown generally by the arrow 25 and if the tool is held and applied to a surface like a pencil, the component of force on the tubular segment will normally tend to move the segment axially inwardly of the mandrel more firmly seating the segment against the shoulder 20.

As indicated, the arbor body 14 is molded onto the mandrel and is formed of a relatively soft material such as black nitrile and has a durometer hardness on the shore A scale of from about 40 to about 60, and preferably from about 45 to about 60. Other rubbery or soft elastomers such as neoprene or urethane rubbers may also be employed. With the proper dimensions held between the arbor and the abrasive segment, a high torque driving connection is formed by the interference fit. When it is desired to change tools, the abrasive segment may quickly be pulled off the arbor and replaced either with a new segment, or a segment having different abrasive characteristics.

Figure 4:
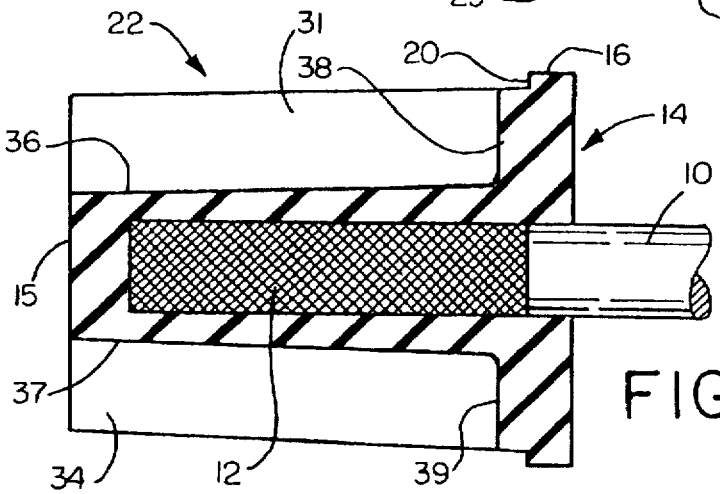
FIG. 4 is a longitudinal section taken substantially from the line 4—4 of FIG. 3.
Figure 3:
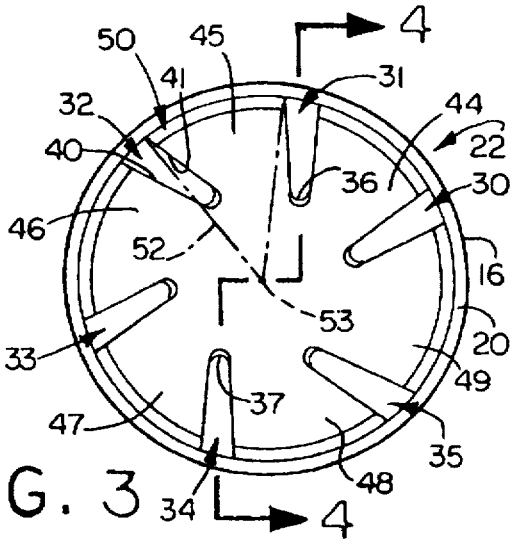
FIG. 3 is an axial end elevation of one embodiment of the invention.

Referring now to FIGS. 3 and 4, it will be seen that the arbor body 22 is provided with a plurality of non-radial slots which are shown generally at 30, 31, 32, 33, 34 and 35. The root or the base of the slots 31 and 34, indicated at 36 and 37 respectively, taper slightly with respect to the axis of the tool as does the exterior of the arbor body. Each of the slots open to the outer end 15 of the arbor body and stop slightly short of the shoulder 20 as indicated at 38 and 39 in FIG. 4. In the embodiment of FIGS. 3 and 4, the slots flare slightly being wider at the circumference of the arbor body than at the root. The width of the slot increases gradually and uniformly toward the periphery of the arbor body. The angle between the interior side walls 40 and 41 of each slot may vary from about 5 to about 10 degrees, for example. In any event, the slot in the embodiment of FIGS. 3 and 4 is substantially wider at its outer end than at the roots 36 and 37.

The slots form asymmetrical projections or fingers seen at 44, 45, 46, 47, 48, and 49. During rotation of the tool, such projections or fingers tend to want to straighten out and become symmetrical. This causes the fingers to expand somewhat, particularly on the counter-clockwise side of the projections as seen in FIG. 3. For the projection 45, the counter-clockwise side is seen at 50. It is this side which is undercut by the wall 41 of the slot 32. Such slot encroaches significantly on the pie-shape segment 52 struck from the center or axis 53 to the periphery of the finger or projection 45. Moreover, if the tool is being rotated in the preferred counter-clockwise direction as seen in FIG. 3, the pressure of the sleeve 18 on the work will create a torque in the opposite or clockwise direction and it can be seen that the torque created by the tool pressure will cause the fingers to distort even more when the tool is rotated in such direction. Accordingly, under speed the centrifugal force makes the asymmetrical projections tend to want to straighten out or become symmetrical and radially expand. This enhances the gripping of the inside diameter of the sleeve more forcefully and enables the torque generated by the tool pressure against the work to enhance the gripping between the arbor and the interior sleeve. The centrifugal distortion and gripping enhancement, however, occurs in either direction of rotation.

Figure 5:
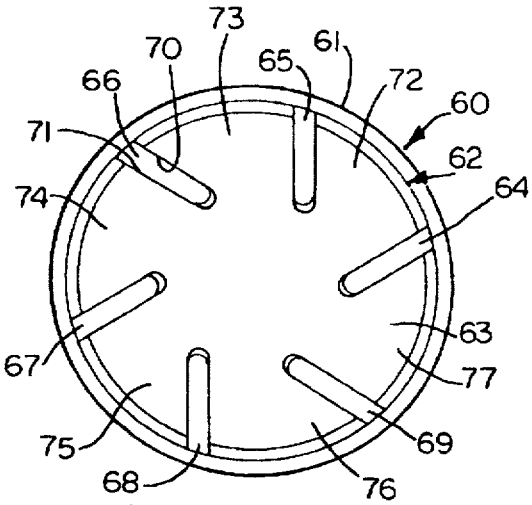
FIG. 5 is a view like FIG. 3 but with non-flaring slots.

Referring now to FIG. 5, there is illustrated a slightly modified tool arbor body shown generally at 60 which includes an inner stop flange 61 and a slightly tapering body 62 which has an outer end face 63. Six non-radial slots 64, 65, 66, 67, 68, and 69 are formed in the arbor body. Unlike the slots of FIG. 3, the slots of FIG. 5 have parallel interior side walls shown at 70 and 71. The slots form projecting asymmetrical fingers 72, 73, 74, 75, 76, and 77. The fingers of the FIG. 5 embodiments have somewhat more mass than the FIG. 3 embodiments, but nonetheless, tend to want to straighten out under centrifugal force. In both embodiments, the fingers assist in the deformation of the arbor body, particularly near the stop flange to accommodate the sleeve easily in a sliding fit. They also distort under centrifugal force to enhance the grip of the arbor on the sleeve interior. Such distortion is primarily at one side of the fingers and at a vector angle with respect to the rotation of the tool so that the grip between the arbor and the interior of the sleeve is enhanced in one direction of rotation, particularly under high torque loads. The slots in both forms also serve to dissipate heat.

It can now be seen that there is provided an abrasive tool utilizing a cylindrical tubular section or sleeve of exteriorally coated abrasive and a relatively soft elastomeric arbor secured to one end of the mandrel. The arbor includes a radially projecting stop flange at its inner end and has a taper configuration which enables the outer end to receive the abrasive tubular sleeve, but which creates an interference fit as the section is telescoped on the arbor until one axial end of the sleeve engages the stop flange. The tapered arbor body is provided with a series of non-radial slots which extend generally chordally to the exterior of the arbor body. The slots may vary in number and may flare slightly as they progress chordally outwardly. The slots form a series of asymmetrical projections which permit the exterior of the body to be more pliable to enable the sleeves more easily to be pulled off or forced on the body when static or not rotating. Yet under speed, centrifugal force makes the asymmetrical projections tend to want to straighten out or become symmetrical and radially expand, at least in part, gripping the inside diameter of the sleeve more forcefully. In one direction of rotation of the sleeve, the fingers resist the torque created by the pressure of the sleeve against the work.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

What is claimed is:

1. An abrasive tool comprising in combination a cylindrical tubular sleeve of exteriorly coated abrasive having an axial length and an inside diameter, and a drive arbor for said sleeve including a mandrel adapted to be rotated by a power tool, and an elastic generally cylindrical arbor body secured to one end of said mandrel and having an outer and inner axial end, said body including a radially projecting stop flange at its inner end, and having a diametrical configuration between the stop flange and its outer end to receive said tubular sleeve with an interference fit as said sleeve is telescoped on said body until one axial end of the said sleeve engages said stop flange wherein said abrasive sleeve has an inside diameter of C, and said body has an outside diameter of A at its outer end and an outside diameter of B at the stop flange end, and wherein C is equal to or greater than A but less than B.

2. A tool as set forth in claim 1 wherein said cylindrical body tapers uniformly from its B dimension to its A dimension.

3. A tool as set forth in claim 1 including a plurality of slots in said body to improve the ability of the sleeve to be inserted on and removed from the arbor body in a static condition.

4. A tool as set forth in claim 3 wherein said slots are non-radial and form asymmetrical projections therebetween.

5. A tool as set forth in claim 4 wherein said projections distort at speed under centrifugal force enhancing the grip of the arbor on the sleeve.

6. A tool as set forth in claim 5 wherein said slots have side walls which flare uniformly.

7. A tool as set forth in claim 1 wherein said mandrel has a knurled end, and said cylindrical body is molded on said knurled end.

8. A tool as set forth in claim 1 wherein said cylindrical body is a relatively soft elastomer having a hardness on the shore A scale of from about 45 to about 60.

9. A tool as set forth in claim 8 wherein said relatively soft material is a nitrile.

10. An abrasive tool comprising an abrasive coated sleeve, a drive arbor for said sleeve including a mandrel adapted to be rotated by a power tool, and an elastic arbor body secured to one end of the mandrel and having an outer and inner end, a stop flange on the inner end of said body against which said sleeve is seated, and a plurality of slots in said body extending from the stop flange to the outer end of the body to improve the ability of the sleeve to be inserted on and removed from the arbor body in a static condition of the tool wherein said abrasive sleeve has an inside diameter of C, and said body has an outside diameter of A at its outer end and an outside diameter of B at the stop flange end, and wherein C is equal to or greater than A but less than B.

11. A tool as set forth in claim 10, wherein said slots are non-radial and form asymmetrical projections therebetween.

12. A tool as set forth in claim 11 wherein said projections distort at speed under centrifugal force enhancing the grip of the arbor on the sleeve.

13. A tool as set forth in claim 12 wherein said slots have side walls which flare uniformly.

14. A tool as set forth in claim 10 wherein said cylindrical body tapers uniformly from its B dimension to its B dimension.

15. A tool as set forth in claim 10 wherein said mandrel has a knurled end, and said cylindrical body is molded on said knurled end.

16. A tool as set forth in claim 10 wherein said cylindrical body is a relatively soft elastomer having a hardness on the shore A scale of from about 45 to about 60.

17. A tool as set forth in claim 16 wherein said relatively soft material is a nitrile.

* * * * *